US008115570B2

(12) United States Patent
Pitschi et al.

(10) Patent No.: US 8,115,570 B2
(45) Date of Patent: Feb. 14, 2012

(54) PHASE SHIFTER

(75) Inventors: Franz Xaver Pitschi, Rottach-Egern (DE); Christoph Hollwich, Munich (DE)

(73) Assignee: Spinner GmbH (DE)

( * ) Notice: Subject to any disclaimer, the term of this patent is extended or adjusted under 35 U.S.C. 154(b) by 368 days.

(21) Appl. No.: 12/512,081

(22) Filed: Jul. 30, 2009

(65) Prior Publication Data

US 2010/0026418 A1 Feb. 4, 2010

(30) Foreign Application Priority Data

Aug. 1, 2008 (DE) ..... 10 2008 035 883

(51) Int. Cl.
*H01P 1/18* (2006.01)

(52) U.S. Cl. ..... 333/160; 333/156

(58) Field of Classification Search ..... 333/160, 333/138, 139, 140, 156, 234, 155, 22 F
See application file for complete search history.

(56) References Cited

U.S. PATENT DOCUMENTS 4,755,778 A 7/1988 Chapell
2003/0146808 A1* 8/2003 Merrill ..... 333/161

OTHER PUBLICATIONS

B.G. Hong et al., Test of KSTAR ICRF Components for Long-Pulse Operation, 0-7803-7908-X/03, 2003 IEEE.

* cited by examiner

*Primary Examiner* — Stephen Jones
(74) *Attorney, Agent, or Firm* — Edell, Shapiro & Finnan, LLC

(57) ABSTRACT

A coaxial phase shifter for very high RF-powers includes an optionally-cooled housing which forms the outer conductor and in which a substantially U-shaped inner conductor made of a tube is arranged which comprises at each of its ends a cooling medium connection for guiding through a cooling medium. The U-shaped inner conductor is externally displaceable for changing its electrical length between a contact-making input-side inner-conductor connection piece and a contact-making output-side inner-conductor connection piece. The inner-conductor connection pieces are disposed coaxially in the outer connection flanges which make contact with the housing.

8 Claims, 1 Drawing Sheet

PHASE SHIFTER

CROSS REFERENCE TO RELATED APPLICATIONS

This application claims priority under 35 U.S.C. §119 to Application No. DE 102008035883.5 filed on Aug. 1, 2008, entitled "A Phase Shifter," the entire contents of which are hereby incorporated by reference.

BACKGROUND OF THE INVENTION

Conventional phase shifters in coaxial piping technology are usually realized in the form of so-called trombones. Conduits of pipes of different diameter are displaced against one another, which means that the change of the electric length is achieved directly by changing the mechanical length of the line system. The diameter ratios (Ø of outer conductor to Ø inner conductor) of the individual conduits of pipes which can be displaced against one another are of the same size in the classic trombone, which means that the characteristic impedance has the same magnitude in all sections (so-called compensation according to Weisfloch). No mismatching thus occurs in a change of the mechanical length and thus the electrical length.

It is planned in the International Thermonuclear Experimental Reactor (ITER) fusion experiment to transfer continuous power in the magnitude of 2 MW via coaxial piping systems for the on cyclotron resonance heating (ICRH) in the frequency range of 40 to 55 MHz. It is therefore necessary to cool the inner conductor as well as the outer conductor of all components (e.g., with water). Water-cooled phase shifters are required for the matching networks.

SUMMARY OF THE INVENTION

A coaxial phase shifter for very high RF-powers includes an optionally-cooled housing that forms the outer conductor and in which a substantially U-shaped inner conductor made of a tube is arranged. The U-shaped inner conductor includes at each of its ends a cooling medium connection for guiding a cooling medium therethrough. The U-shaped inner conductor is displaceable for changing its electrical length between a contact-making input-side inner-conductor connection piece and a contact-making output-side inner-conductor connection piece. The inner-conductor connection pieces are disposed coaxially in the outer connection flanges which make contact with the housing.

DETAILED DESCRIPTION OF THE INVENTION

Figure 1:
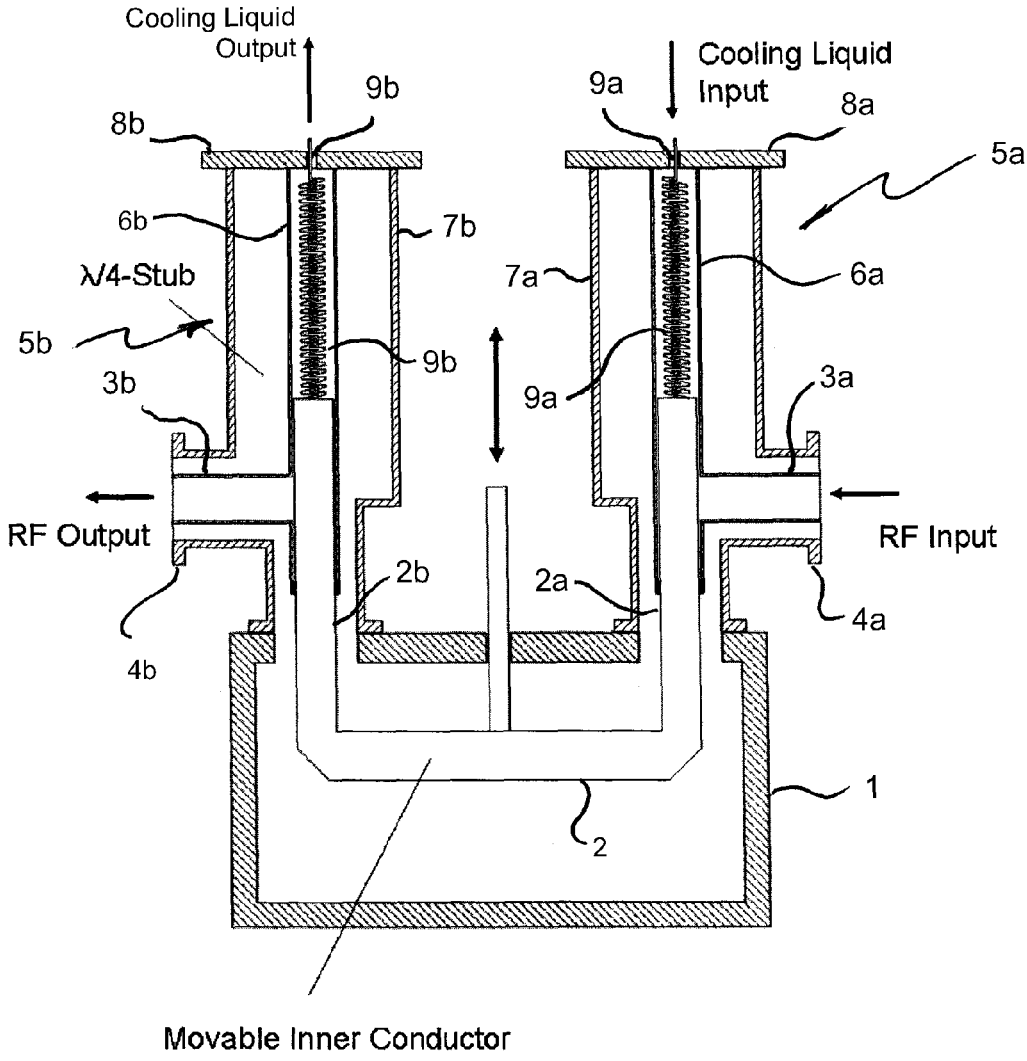
FIG. 1 illustrates a cross-sectional view of a coaxial phase shifter in accordance with an embodiment of the invention.

The present invention is directed toward a phase shifter (a so-called box trombone), wherein only a U-shaped inner conductor is moved in a housing configured to function as an outer conductor. The dimensions of the inner conductor are chosen in such a way that the desired characteristic impedance is obtained with the walls of the outside conductor. Although a slight mismatching via the hub of the phase shifter may occur, the level of mismatching is still tolerable for certain applications.

FIG. 1 shows the phase shifter with integrated λ/4 stubs in accordance with an embodiment of the invention. As illustrated, the coaxial phase shifter includes a housing 1 that forms an outer conductor and a substantially U-shaped inner conductor 2 arranged within the housing. The phase shifter further includes a first or input side inner-conductor connection piece 3*a* coaxially disposed in a first or input side outer connection flange 4*a* and a second or output side inner-conductor connection piece 3*b* disposed coaxially within a second or output side outer connection flange 4*b*. Each of the outer connection flanges 4*a*, 4*b* are in contact with the housing 1.

The U-shaped inner conductor 2 is displaceable (e.g., movable from the exterior to the phase shifter) such that its electric length between the contact-making, input-side, inner-conductor connection piece 3*a* and the contact-making, output-side, inner-conductor connection piece 3*b* can be adjusted.

The U-shaped inner conductor 2 includes a first longitudinal legs 2*a* and a second longitudinal leg 2*b*, each of which plunges into a corresponding inner conductor 6*a*, 6*b* of a λ/4 short-circuit line 5*a*, 5*b*, which is adjusted with respect to its length to the center frequency of the phase shifter and whose outer conductors 7*a*, 7*b* make contact with the housing 1.

Each of the λ/4 short-circuit lines 5*a*, 5*b* terminates in a corresponding short-circuit plate 8*a*, 8*b*, which includes a lead-through for a cooling medium line 9*a*, 9*b*. The U-shaped inner conductor 2 further includes a tube with a cooling medium connection at each of its ends for guiding through a cooling medium. The part of the cooling medium line 9*a*, 9*b* that is disposed within the inner conductor 6*a*, 6*b* of each of the λ/4 short-circuit lines 5*a*, 5*b* bridges the adjusting path of the U-shaped inner conductor 2 in a longitudinally elastic manner. By way of specific example, the cooling medium line 9*a*, 9*b* may be coiled.

The U-shaped inner conductor 2 is guided in a support-free manner only over the contacts with the inner-conductor connection pieces 3*a*, 3*b*.

In one embodiment of the phase shifter, the outer connection flanges are pivotally coupled to the housing 1 jointly with their respective inner-conductor connection pieces 3*a*, 3*b*. In addition, at least one of the outer connection flanges 4*a*, 4*b* may be arranged on the outer conductor 7*a*, 7*b* of the equilateral λ/4 short-circuit line 5*a*, 5*b*; moreover, the λ/4 short-circuit line 5*a*, 5*b* may be rotatably coupled to the housing 1, being rotatable about its central axis. In still other embodiments, the housing 1 includes an external cooling mechanism.

The phase shifter of FIG. 1 may further include a mechanism for cooling the inner conductor of the λ/4 stubs, a mechanism for cooling the outer conductor, and a drive mechanism (none illustrated).

Thus, the present invention provides a phase shifter with integrated water cooling for the inner and outer conductor. Only the position of the U-shaped inner conductor needs to be changed for changing the phase. A plurality of λ/4 stubs are used for water supply. The U-shaped inner conductor 2 is partly arranged in a specially adapted waveguide structure, which means that its cross sectional has been determined by calculation in such a way that the voltage standing wave ratio (VSWR) of the phase shifter is as small as possible. The two legs 2*a*, 2*b* of the U-shaped inner conductor 2 are accommodated in the retracted state by the inner conductors of the λ/4 stubs (i.e. at the smallest electrical length of the phase shifter). Tubing wound in a helical manner is integrated in the inner conductors of the λ/4 stubs with which the movable inner conductor 2 is supplied with cooling water.

The above-described configuration provides several advantages over the prior art. For example, as a result of the high integration of the mechanical components, the structural shape will become very compact in comparison with conventional phase shifters (as described above), in combination with simultaneous optimization of the electric properties. In addition, the number of the support insulators can be minimized. This promotes electric strength. Furthermore, very simple supply and discharge of cooling medium is enabled.

As a result of the concept with the λ/4 stubs, accessibility and thus maintenance of the cooling systems is substantially simplified. Moreover, the cooling medium is not guided through the RF-field. Since no sliding contacts are necessary between the outer conductors as in the conventional phase shifter, RF-tightness is outstanding. It corresponds to that of a rigid coaxial line connected by means of flanges.

Also, in the inventive phase shifter, only static seals need to be implemented with the exception of the dynamic seal for the lead-through of the pushrod for the U-shaped inner conductor. The input flange and the output flange can be arranged to be pivotable about the longitudinal axis of the λ/4 stub. This ensures an adjustment to the mounting situation with the consequence of a reduced need for space.

Finally, by switching two phase shifters behind one another it is possible to reduce the mechanical construction depth for a predetermined region of the phase shifting. In this arrangement, the contact path and the sliding speed of the sliding contacts are halved at a given phase change. This is advantageous at operation under RF-load. Moreover, the wear and tear of the contacts will decrease.

What is claimed is:

1. A coaxial phase shifter comprising:

a housing;

a substantially U-shaped inner conductor arranged within the housing, wherein the U-shaped inner conductor is displaceable within the housing from a point exterior to the housing;

an input side inner-conductor connection piece disposed coaxially in a first outer connection flange in contact with the housing; and an output side inner-conductor connection piece disposed coaxially in a second outer connection flange in contact with the housing, wherein displacing the U-shaped inner conductor changes the electric length between the U-shaped conductor and the inner-conductor connection pieces, and wherein the U-shaped inner conductor includes a tube having a cooling medium connection at each of its ends, the tube being configured to guide cooling medium therethrough.

2. The coaxial phase shifter according to claim 1, wherein the U-shaped inner conductor is guided in a support-free manner over the contacts with the inner-conductor connection pieces.

3. The coaxial phase shifter according to claim 1, wherein the outer connection flanges are pivotally coupled to the housing jointly with their respective inner-conductor connection pieces.

4. The coaxial phase shifter according to claim 1, wherein the substantially U-shaped conductor includes a first longitudinal leg and a second longitudinal leg, wherein each longitudinal leg is disposed within an inner conductor of a λ/4 short-circuit line;

the λ/4 short-circuit line includes outer conductors in contact with the housing 1;

at least one of the outer connection flanges is arranged on the outer conductor of the λ/4 short-circuit line; and each λ/4 short-circuit line is rotatably coupled to the housing such that the short circuit line rotates about its central axis.

5. The phase shifter according to claim 1, wherein the housing has an external cooling mechanism.

6. The coaxial phase shifter according to claim 1, wherein:

the substantially U-shaped conductor includes a first longitudinal leg and a second longitudinal leg;

each longitudinal leg is disposed within an inner conductor of a λ/4 short-circuit line which is adjusted with respect to its length to a center frequency of the phase shifter; and the λ/4 short-circuit line includes outer conductors in contact with the housing 1.

7. The coaxial phase shifter according to claim 6, wherein each of the λ/4 short-circuit lines terminates in a short-circuit plate comprising a lead-through for a cooling medium line.

8. The coaxial phase shifter according to claim 7, wherein:

a portion of the cooling medium line is disposed within the inner conductor of each of the λ/4 short-circuit lines; and the portion of the cooling medium line disposed within the inner conductor of each of the λ/4 short-circuit lines bridges the adjusting path of the U-shaped inner conductor in a longitudinally elastic manner.

* * * * *